US010876253B2

(12) United States Patent
Van Der Kraan et al.

(10) Patent No.: US 10,876,253 B2
(45) Date of Patent: Dec. 29, 2020

(54) METHOD OF DYEING A SUBSTRATE COMPRISING ELASTOMERIC FIBRE AND NON-ELASTOMERIC FIBRE, AND A DYED SUBTRATE COMPRISING THESE FIBRES

(71) Applicant: DYECOO TEXTILE SYSTEMS B.V., Weesp (NL)

(72) Inventors: Martijn Van Der Kraan, Weesp (NL); Lara Gonzalez Lopez, Weesp (NL); Ernst-Jan Siewers, Weesp (NL); Geert Feye Woerlee, Weesp (NL)

(73) Assignee: DYECOO TEXTILE SYSTEMS B.V., Weesp (NL)

( * ) Notice: Subject to any disclaimer, the term of this patent is extended or adjusted under 35 U.S.C. 154(b) by 247 days.

(21) Appl. No.: 15/998,652

(22) PCT Filed: Feb. 18, 2016

(86) PCT No.: PCT/NL2016/050119
§ 371 (c)(1),
(2) Date: Aug. 16, 2018

(87) PCT Pub. No.: WO2017/142395
PCT Pub. Date: Aug. 24, 2017

(65) Prior Publication Data
US 2020/0263353 A1 Aug. 20, 2020

(51) Int. Cl.
*D06P 3/82* (2006.01)
*D06P 1/19* (2006.01)
*D06P 1/94* (2006.01)

(52) U.S. Cl.
CPC ..... *D06P 3/8204* (2013.01); *D06P 1/19* (2013.01); *D06P 1/94* (2013.01)

(58) Field of Classification Search
CPC ..... D06P 3/8204; D06P 1/19; D06P 1/94
See application file for complete search history.

(56) References Cited

U.S. PATENT DOCUMENTS

2002/0069467 A1* 6/2002 Immediato ..... D06P 1/0032 8/499
2004/0019983 A1* 2/2004 Brierley ..... C09B 67/0033 8/453
2014/0123407 A1* 5/2014 Arnold ..... C09B 67/0051 8/641

FOREIGN PATENT DOCUMENTS

EP 2 672 002 A1 12/2013
EP 2672002 * 12/2013 ..... D06P 7/00
EP 1 394 218 A1 3/2014

OTHER PUBLICATIONS

International Search Report issued in PCT/NL2016/050119, dated Nov. 2, 2016.
Written Opinion of the International Searching Authority issued in PCT/NL2016/050119, dated Nov. 2, 2016.

* cited by examiner

*Primary Examiner* — Amina S Khan
(74) *Attorney, Agent, or Firm* — Foley & Lardner LLP

(57) ABSTRACT

A dyeing method comprising a) dyeing a substrate containing (i) elastomeric fiber containing at least 30 wt. % of a first polymer having a glass transition temperature T1 of less than 60° C. and (ii) non-elastomeric companion fiber containing more than 50 wt. % of a second polymer, said second polymer being polymer having no glass transition temperature or polymer having a glass transition temperature T2 that is at least 20° C. higher than T1, b) contacting the pre-dyed substrate with an extraction medium at a temperature Te and a pressure Pe, said extraction medium comprising at least 50 wt. % of supercritical or liquefied carbon dioxide; wherein Te exceeds Tg1,extraction and wherein Te is less than Tg2,extraction in case the companion 1 fiber contains more than 50 wt. % of polymers having a glass transition temperature T2; Tg1,extraction representing the glass transition temperature of the first polymer in carbon dioxide at pressure Pe; and Tg2,extraction representing the glass transition temperature of the second polymer in carbon dioxide at pressure Pe.

16 Claims, 1 Drawing Sheet

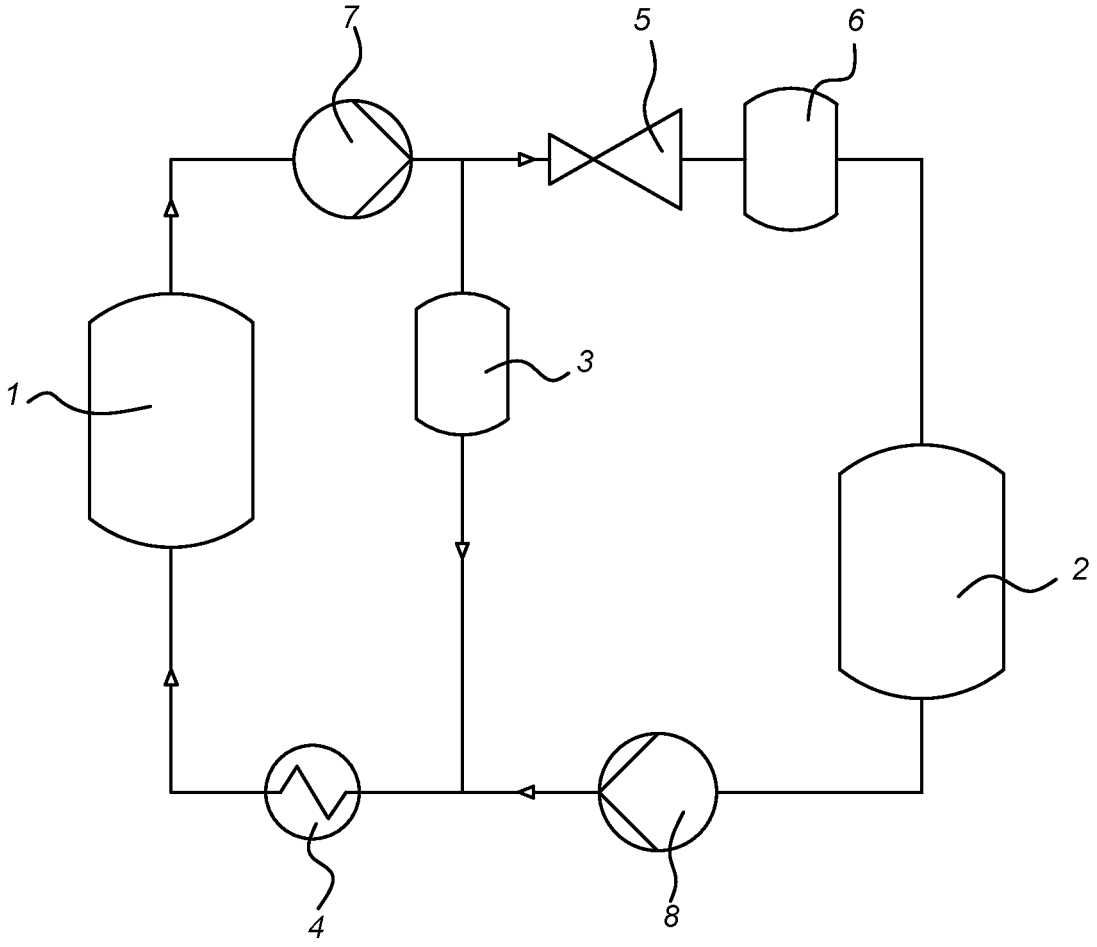
7
5
6
1
3
2
4
8

METHOD OF DYEING A SUBSTRATE COMPRISING ELASTOMERIC FIBRE AND NON-ELASTOMERIC FIBRE, AND A DYED SUBTRATE COMPRISING THESE FIBRES

CROSS-REFERENCE TO RELATED APPLICATIONS

This application is the National Phase of International Patent Application No. PCT/NL2016/050119, filed Feb. 18, 2016, published on Aug. 24, 2017 as WO 2017/142395 A1. The entire disclosure of which is incorporated herein by reference in its entirety.

TECHNICAL FIELD OF THE INVENTION

The present invention relates to the dyeing of substrates containing elastomeric fibre in combination with non-elastomeric companion fibre. Examples of substrates containing a combination of elastomeric fibre and non-elastomeric companion fibre are fabric that are composed of spandex (an elastomeric fibre) and polyester or cotton (non-elastomeric fibres).

The invention provides a method of dyeing a substrate comprising (i) elastomeric fibre containing at least 30 wt. % of a first polymer having a glass transition temperature $T_1$ of less than 60° C. and (ii) non-elastomeric companion fibre containing more than 50 wt. % of a second polymer, said second polymer being polymer having no glass transition temperature or polymer having a glass transition temperature $T_2$ that is at least 20° C. higher than $T_1$, said method comprising:

a) contacting the substrate with a dyeing medium to produce a pre-dyed substrate comprising dyed elastomeric fibre and dyed companion fibre;

b) contacting the pre-dyed substrate with an extraction medium at a temperature $T_e$ and a pressure $P_e$, to produce a high fastness dyed substrate, said extraction medium comprising at least 50 wt. % of supercritical or liquefied carbon dioxide;

wherein $T_e$ exceeds $T_{g1,extraction}$ and wherein $T_e$ is less than $T_{g2,extraction}$ in case the companion fibre contains more than 50 wt. % of polymers having a glass transition temperature $T_2$; $T_{g1,extraction}$ representing the glass transition temperature of the first polymer in carbon dioxide at pressure $P_e$; and $T_{g2,extraction}$ representing the glass transition temperature of the second polymer in carbon dioxide at pressure $P_e$.

The present method yields a dyed substrate with exceptional colour fastness, despite the presence of elastomeric fibres.

The invention further provides a dyed substrate comprising:

(i) elastomeric fibre containing at least 30 wt. % of a first polymer and 0.01 mg/kg to 10 g/kg of a first dye, said first polymer having a glass transition temperature $T_1$ of less than 60° C.; and (ii) non-elastomeric companion fibre containing more than 50 wt. % of a second polymer and at least 1 g/kg of a second dye, said second polymer being polymer having no glass transition temperature or polymer having a glass transition temperature $T_2$ that is at least 20° C. higher than $T_1$;

wherein the first dye and the second dye are composed of the same one or more dyestuffs; and wherein the concentration of the first dye in the elastomeric fibre is at least three times lower than the concentration of the second dye in the companion fibre.

BACKGROUND OF THE INVENTION

Spandex (also known as Lycra® or elastane) is a synthetic elastomeric fibre known for its exceptional elasticity. Spandex is a complex segmented block polymer, typically comprising at least 85 wt. % of segmented polyurethane. Spandex is produced through reaction of a diisocyanate with polyethers or polyesters and subsequent crosslinking of polyurethane units. Initially, low molecular weight polyethers and polyesters (oligomers) containing reactive terminal hydroxyl and/or carboxyl groups are reacted with diisocyanates by step growth polymerization to form a capped prepolymer. This polymer is melt spun or solvent spun from N,N-dimethylformamide into a fiber; then the fiber is passed through a cosolvent containing a reactive solvent such as water that reacts with the terminal isocyanate groups to form urethane crosslinks.

The polyether or polyester segments in spandex are amorphous and in a state of random disorder, while urethane groups segmenting the polyether or polyester segments can form hydrogen bonds and undergo van der Waals interactions with urethane groups on adjacent chains. Chain ends will be crosslinked or joined to other chains through urea groups. On stretching, the amorphous segments of the molecular chains become more ordered up to the limit set by the urea linkages.

Because of its elasticity and strength (stretching up to five times its length), spandex has been incorporated into a wide range of garments, especially in skin-tight garments. A benefit of spandex is its significant strength and elasticity and its ability to return to the original shape after stretching and faster drying than ordinary fabrics.

For clothing, spandex fibres are usually mixed with cotton or polyester fibres, and accounts for a small percentage of the final fabric, which therefore retains most of the look and feel of the other fibres.

Spandex fibers can be dyed with disperse, acid, reactive, basic, or vat dyes. However, dyed spandex fibres exhibit very poor colour fastness, especially when dyed with non-reactive dyes. When used in skin-tight garments, the low colour fastness of dyed spandex fibres becomes apparent in that dye is transferred from the spandex fibres onto skin. Likewise, dye is readily transferred from dyed spandex fibres to other fabrics during laundry washing and storage.

Elastomeric fibres typically have a higher affinity for dyes, especially disperse dyes, than the non-elastomeric fibres they are combined with. Thus, during dyeing, elastomeric fibres usually pick up substantially more dye than non-elastomeric fibres. This aggravates the problems associated with the poor colour fastness of dyed elastomeric fibres and even causes fabrics containing small quantities of dyed elastomeric fibre to noticeably transfer dye to skin or to other fabrics during washing and storage.

US 2002/0069467 describes a process of jet-dyeing a fabric comprising an elastomeric fiber, comprising the steps of:

a) providing a jet-dyeing machine;

b) adding water and a textile dyebath lubricant to the machine to form a bath, and heating the bath to at least about 40° C.;

c) adding the fabric to the bath after step (b);

d) adding at least one dye to the bath; and e) heating the bath to the dyeing temperature.

Example 1 of US 2002/0069467 describes the dyeing of a fabric that was knit from 78 dtex spandex and poly (ethylene terephthalate) yarn. The fabric was 11 wt % spandex and 89 wt % polyester. A jet-dyeing machine was used to dye the fabric. Water and lubricant were added to the machine. The resulting dyebath was heated to 40° C., the knit fabric was added, after which a pH control agent from Sandoz) and pre-mixed dyes were added (1.175% Foron Brilliant Yellow S6GL (C.I. Disperse Yellow 231), 0.915% Foron Rubine RD-GFL 200, and 2.925% Foron Navy RD RLS-300). The dyebath was heated at a rate of 1.5° C./minute. After the bath reached 120° C., the machine was run for 30 minutes, then cooled at 1.5° C./minute to 80° C. In a reduction clearing step, sodium hydroxide and thiourea dioxide were added. The machine was run for 20 minutes, and while the bath was being cooled, the fabric was rinsed with overflow at 70° C. and again at 60° C. Reduction clearing is used in the dyeing of fabrics to remove unfixed dye.

SUMMARY OF THE INVENTION

The inventors have developed an improved method for dyeing a substrate comprising elastomeric fibre, such as spandex, in combination with a non-elastomeric companion fibre, such as polyester or cotton. More particularly, the present invention relates to a method of dyeing a substrate comprising (i) elastomeric fibre containing at least 30 wt. % of a first polymer having a glass transition temperature $T_1$ of less than 60° C. and (ii) non-elastomeric companion fibre containing more than 50 wt. % of a second polymer, said second polymer being polymer having no glass transition temperature or polymer having a glass transition temperature $T_2$ that is at least 20° C. higher than $T_1$, said method comprising:

a) contacting the substrate with a dyeing medium to produce a pre-dyed substrate comprising dyed elastomeric fibre and dyed companion fibre;

b) contacting the pre-dyed substrate with an extraction medium at a temperature $T_e$ and a pressure $P_e$, to produce a high fastness dyed substrate, said extraction medium comprising at least 50 wt. % of supercritical or liquefied carbon dioxide;

wherein $T_e$ exceeds $T_{g1,extraction}$ and wherein $T_e$ is less than $T_{g2,extraction}$ in case the companion fibre contains more than 50 wt. % of polymers having a glass transition temperature $T_2$; $T_{g1,extraction}$ representing the glass transition temperature of the first polymer in carbon dioxide at pressure $P_e$; and $T_{g2,extraction}$ representing the glass transition temperature of the second polymer in carbon dioxide at pressure $P_e$.

Elastomeric fibres typically are made of polymers that have a glass transition temperature of less than 60° C., whereas non-elastomeric fibres are usually made of polymers that have no glass transition temperature and/or a glass transition temperature that lies well above ambient temperature. Spandex, for instance, has a glass transition temperature of −45° C., whereas polyester typically has a glass transition temperature of 78° C. Cotton, on the other hand, does not have a glass transition temperature.

Hydrophobic fibres such as polyester are usually dyed at temperatures above their glass transition temperature as dye is much more easily absorbed by fibres that are in a 'rubbery' state than fibres that are in a 'glassy' state. At temperatures below the glass transition temperature dye is effectively entrapped in the 'glassy' matrix of dyed fibres. The fact that elastomeric fibres have low glass transition temperatures probably is the main reason why dyed elastomeric fibres generally exhibit low colour fastness.

In the present dyeing method both the elastomeric fibre and the non-elastomeric companion fibre are dyed effectively in dyeing step a), whereas in step b) dye is selectively removed from elastomeric fibre.

Although the inventors do not wish to be bound by theory it is believed in step b) dye is readily removed from the elastomeric fibre in the pre-dyed substrate because the contacting of the pre-dyed substrate and the extraction medium occurs at a temperature above the glass transition temperature of the first polymer (under the extraction conditions employed). In case the companion fibre contains more than 50 wt. % of polymers having a glass transition temperature that is at least 20° C. higher than $T_1$, the pre-dyed substrate is contacted with the extraction medium at a temperature that is below the glass transition temperature of the second polymer (under the extraction conditions employed) to minimise removal of dye from the companion fibre.

It is well-established that sorption of supercritical or liquefied carbon dioxide into polymers results in their swelling and changes the mechanical and physical properties of the polymers. A particularly important effect of this swelling is the reduction of the glass transition temperature of glassy polymers, often referred to as 'plasticization'. Due to plasticization the glass transition point of a polymer in supercritical or liquefied carbon dioxide can be substantially lower than the glass transition point of the same (dry) polymer at atmospheric pressure.

The present method enables the production of dyed substrates containing elastomeric fibre as well as non-elastomeric companion fibre that exhibit extremely high colour fastness because the dye is almost exclusively contained in the companion fibres which inherently exhibit high colour fastness.

The use of a supercritical fluid or liquefied gas to selectively remove dye from the elastomeric fibre is extremely efficient and more effective than reduction clearing. Furthermore, the method of the present invention offers the additional advantage that, unlike reduction clearing, it does not require the use of chemicals to remove dye from the elastomeric fibres. Furthermore, it does not generate the wastewater that is normally associated with reduction cleaning.

The present invention also provides a dyed substrate comprising:

(i) elastomeric fibre containing at least 30 wt. % of a first polymer and 0.01 mg/kg to 10 g/kg of a first dye, said first polymer having a glass transition temperature $T_1$ of less than 60° C.; and (ii) non-elastomeric companion fibre containing more than 50 wt. % of a second polymer and at least 1 g/kg of a second dye, said second polymer being polymer having no glass transition temperature or polymer having a glass transition temperature $T_2$ that is at least 20° C. higher than $T_1$;

wherein the first dye and the second dye are composed of the same one or more dyestuffs; and wherein the concentration of the first dye in the elastomeric fibre is at least three times lower than the concentration of the second dye in the companion fibre.

DRAWINGS

FIG. 1 schematically depicts a dyeing machine that can be used to carry out the dyeing method of the present invention.

DETAILED DESCRIPTION OF THE INVENTION

A first aspect of the present invention relates to a method of dyeing a substrate comprising (i) elastomeric fibre containing at least 30 wt. % of a first polymer having a glass transition temperature $T_1$ of less than 60° C. and (ii) non-elastomeric companion fibre containing more than 50 wt. % of a second polymer, said second polymer being polymer having no glass transition temperature or polymer having a glass transition temperature $T_2$ that is at least 20° C. higher than $T_1$, said method comprising:

a) contacting the substrate with a dyeing medium to produce a pre-dyed substrate comprising dyed elastomeric fibre and dyed companion fibre;

b) contacting the pre-dyed substrate with an extraction medium at a temperature $T_e$ and a pressure $P_e$, to produce a high fastness dyed substrate, said extraction medium comprising at least 50 wt. % of supercritical or liquefied carbon dioxide;

wherein $T_e$ exceeds $T_{g1,extraction}$ and wherein $T_e$ is less than $T_{g2,extraction}$ in case the companion fibre contains more than 50 wt. % of polymers having a glass transition temperature $T_2$; $T_{g1,extraction}$ representing the glass transition temperature of the first polymer in carbon dioxide at pressure $P_e$; and $T_{g2,extraction}$ representing the glass transition temperature of the second polymer in carbon dioxide at pressure $P_e$.

The term "elastomeric fibre" as used herein refers to a fibre which, free of diluents, has a break elongation in excess of 100% independent of any crimp and which when stretched to twice its length, held for one minute, and then released, retracts to less than 1.5 times its original length within one minute of being released. Examples of elastomeric fibers include spandex, polyetherester fiber, and elastoester.

The term "non-elastomeric companion fibre" as used herein refers to a fibre that is not an elastomeric fibre.

The term "polymer" as used herein, unless indicated otherwise, refers to a synthetic or natural macromolecule that is composed of many repeated subunits and that has a molecular weight of at least 10 kDa.

The term "glass transition" as used herein refers to the reversible transition in amorphous materials (or in amorphous regions within semicrystalline materials) from a hard and relatively brittle state into a molten or rubber-like state. The glass transition temperatures $T_1$ and $T_2$ are determined under atmospheric conditions using the method described in ASTM standards E 1545-11 (*Standard Test Method for Assignment of the Glass Transition Temperature by Thermomechanical Analysis*). The glass transition temperatures $T_{g1,dyeing}$, $T_{g1,extraction}$, $T_{g2,\ dyeing}$ and $T_{g2,extraction}$ can be determined using the DSC-method described by Zhong et al. (*High-pressure DSC study of thermal transitions of a poly (ethylene terephthalate)/carbon dioxide system*, Polymer, 40(13), June 1999, 3829-3834).

The term "dye" as used herein refers to a dyestuff or a combination of dyestuffs.

The term "dyestuff" as used herein refers to a coloured chemical substance that can be used to dye a substrate due to the affinity and/or reactivity of the coloured substance to said substrate.

The term "disperse dyestuff" as used herein refers to a dyestuff that is essentially water-insoluble.

The term "reactive disperse dyestuff" as used herein refers to a disperse dyestuff that is capable of reacting with components of the non-elastomeric companion fibre.

The substrate that is dyed in the present method preferably is yarn, fabric or garment. More preferably, the substrate is fabric, even more preferably a knitted fabric, woven fabric or non-woven fabric.

The elastomeric fibre in the substrate typically represents at least 1 wt. %, more preferably 1-35 wt. % and most preferably 3-20 wt. % of the substrate. The non-elastomeric companion fibre typically represents at least 65 wt. %, more preferably 65-99 wt. % and most preferably 80-97 wt. % of the substrate.

Together, the elastomeric fibre and the companion fibre preferably constitutes at least 30 wt. %, more preferably at least 50 wt. % and most preferably at least 80 wt. % of the substrate.

Both the elastomeric fibre and the non-elastomeric companion fibre in the substrate may be composed of a single polymer or a mixture of two or more polymers.

The elastomeric fibre typically contains less than 20 wt. % of the second polymer that constitutes at least 30 wt. % of the non-elastomeric fibre. More preferably, the elastomeric fibre contains less than 10 wt. %, most preferably less than 5 wt. % of the second polymer.

The amount of first polymer in the elastomeric fibre preferably is at least 60 wt. %, more preferably at least 80 wt. % and most preferably at least 90 wt. %.

The glass transition temperature $T_1$ of the first polymer preferably is less than 40° C., more preferably less than 20° C. and most preferably −70 to 0° C.

The glass transition temperature $T_{g1,extraction}$ of the first polymer preferably is less than 30° C., more preferably less than 10° C. and most preferably −75 to −5° C.

According to a particularly preferred embodiment the first polymer comprises at least 85 wt. % of segmented polyurethane. Spandex is an example of such a first polymer.

The companion fibre typically contains less than 20 wt. % of the first polymer that constitutes at least 30 wt. % of the elastomeric fibre. More preferably, the companion fibre contains less than 10 wt. %, most preferably less than 5 wt. % of the first polymer.

The companion fibre typically contains at least 60 wt. %, preferably at least 80 wt. % and most preferably at least 90 wt. % of the second polymer.

In accordance with an advantageous embodiment of the present invention, the second polymer has a glass transition temperature $T_2$ that is at least 20° C. higher than $T_1$ and the method comprises the steps of:

contacting the substrate with the dyeing medium at a pressure $P_d$ and a temperature $T_d$ that exceeds $T_{g2,\ dyeing}$; and contacting the pre-dyed substrate with the extraction medium at a temperature that is below $T_{g2,extraction}$: $T_{g2,dyeing}$ representing the glass transition temperature of the second polymer in carbon dioxide at pressure $P_d$.

By contacting the substrate with the dyeing medium at a temperature that exceeds $T_{g2,dyeing}$ it is ensured that the dye is readily absorbed by the second polymer. By contacting the pre-dyed substrate with the extraction medium at a temperature that is below $T_{g2,extraction}$ it is further ensured that extraction of dye from the companion fibre is minimised.

In this particular embodiment of the dyeing method the substrate is preferably contacted with the dyeing medium at a temperature that is at least 5° C., more preferably at least 15° C. and most preferably at least 25° C. above $T_{g2,dyeing}$.

The pre-dyed substrate is preferably contacted with the extraction medium at a temperature that is at least 2° C. below $T_{g2,extraction}$, more preferably at least 4° C. below $T_{g2,extraction}$, and most preferably at least 5° C. below $T_{g2,extraction}$.

The glass transition temperature $T_2$ of the second polymer preferably is at least 30° C., more preferably 40-100° C. and most preferably 45-80° C. The glass transition temperature $T_2$ typically is at least 20° C., more preferably at least 40° C. and most preferably 70-130° C. higher than the glass transition temperature $T_1$.

The glass transition temperature $T_{g2,extraction}$ of the second polymer that is employed in accordance with the aforementioned embodiment preferably is at least 10° C., more preferably 20-100° C. and most preferably 30-80° C. The glass transition temperature $T_{g2,extraction}$ typically is at least 20° C., more preferably at least 40° C. and most preferably 70-130° C. higher than the glass transition temperature $T_{g1,extraction}$.

In accordance with another embodiment of the present dyeing method, the second polymer is cellulose and the method comprises the steps of contacting the substrate with a dyeing medium containing a reactive dyestuff, followed by contacting of the pre-dyed substrate with the extraction medium at a temperature of not more than 120° C. Preferably, the reactive dye employed in this embodiment is a reactive disperse dyestuff.

The second polymer is preferably selected from polyester, nylon, rayon, cellulose, aramids, silk, wool, polyolefins and combinations thereof. More preferably, the second polymer is selected from polyester, cellulose and combinations thereof. Cotton is an example of a cellulose polymer that may suitably be employed as second polymer. Most preferably, the second polymer is polyester.

The dyeing medium that is applied in the present method typically contains dye in a concentration of $5\times10^{-5}$-$10^{-1}$ wt. %, more preferably of $10^{-4}$-$5\times10^{-2}$ wt. % and most preferably of $2.5\times10^{-4}$-$10^{-2}$ wt. %.

The dye that is contained in the dyeing medium preferably contains one or more dyestuffs selected from disperse dyestuff, reactive dyestuff, VAT dyestuff, acid dyestuff and direct dyestuff. Preferably, the dye contains one or more dyestuffs that are not reactive towards the elastomeric fibre.

The benefits of the present invention are particularly appreciated when the substrate is dyed with disperse dyestuff (including reactive as well as non-reactive disperse dyestuff). Accordingly, in a particularly preferred embodiment the dye employed in accordance with the present invention includes disperse dyestuff. Disperse dyestuff preferably constitute at least 50 wt. %, more preferably at least 80 wt. % and most preferably at least 90 wt. % of the dyestuffs contained in the dyeing medium.

According to a particularly preferred embodiment, the dyeing medium contains $5\times10^{-5}$-$10^{-1}$ wt. %, more preferably $10^{-4}$-$5\times10^{-2}$ wt. % and most preferably $2.5\times10^{-4}$-$10^{-2}$ wt. % of one or more disperse dyestuffs.

The dyeing medium used in the present method preferably is a fluid, more preferably a fluid selected from a supercritical fluid, a liquefied gas and an aqueous liquid. More preferably, the dyeing medium employed in the present method comprises at least 50 wt. % a supercritical fluid, a liquefied gas or an aqueous liquid.

Other components that may suitably be present in the dyeing medium besides fluid and dye include co-solvents, fiber swelling agents such as water or alcohols, reaction catalysts such as acids or bases, surfactants, finishing agents (e.g. softeners, water- and soil repellents, flame retardants, antistatic agents) and combinations thereof.

According to one preferred embodiment, the dyeing medium comprises at least 50 wt. % of a supercritical fluid. More preferably, the dyeing medium contains at least 70 wt. % of supercritical fluid, most preferably at least 80 wt. % of a supercritical fluid.

The dyeing medium employed in accordance with this embodiment advantageously contains at least 70 wt. %, more preferably at least 80 wt. % and most preferably at least 90 wt. % of carbon dioxide.

The dyeing medium containing the supercritical fluid preferably has a pressure in excess of 50 bar, more preferably in excess of 100 bar and most preferably in the range of 200-400 bar.

In accordance with another advantageous embodiment the dyeing medium comprises at least 50 wt. %, more preferably at least 70 wt. % and most preferably at least 80 wt. % of an aqueous liquid.

The pre-dyed substrate typically contains at least 0.01%, more preferably at least 0.05% and most preferably 0.1-4% dye calculated by weight of the fibres contained therein. Expressed differently, the pre-dyed substrate preferably contains at least 0.01 wt. %, more preferably at least 0.05 wt. % and most preferably at least 0.1 wt. % of dye.

The pre-dyed substrate is preferably contacted with the extraction medium at a temperature that exceeds $T_{g1,extraction}$ by at least 5° C., more preferably by at least 10° C., and most preferably by at least 60° C. Expressed differently, the substrate is preferably contacted with the extraction medium at a temperature of at least −10° C., more preferably of 10-60° C. and most preferably of 15-55° C.

The extraction medium that is employed in the present method to selectively remove dye from the elastomeric fibre typically comprises at least 60 wt. %, more preferably at least 70 wt. % and most preferably at least 80 wt. % of supercritical or liquefied carbon dioxide. According to a particularly preferred embodiment the extraction medium contains a supercritical carbon dioxide in the specified concentration.

Other components that may suitably be present in the extraction medium include co-solvents, water, gases, surfactants and combinations thereof.

The pre-dyed substrate is typically contacted with the extraction medium at a pressure in excess of 50 bar, more preferably at a pressure of at least 100 bar and most preferably at a pressure in the range of 50-400 bar.

In between steps a) and b) of the present method the substrate may be kept under pressure. Alternatively, between steps a) and b) pressure is reduced to atmospheric pressure. Preferably, the substrate is kept at a pressure of at least 50 bar between steps a) and b).

Typically, the pre-dyed substrate is contacted with the extraction medium at a temperature in the range of 10-80° C., more preferably in the range of 15-70° C. and most preferably in the range of 15-50° C.

As a result of the contacting of the pre-dyed substrate with the extraction medium typically at least 30 wt. %, more preferably at least 40 wt. %, and most preferably at least 50 wt. % of the dye contained in the elastomeric fibre is removed therefrom. Although the present method enables almost complete removal of the dye contained in the elastomeric fibre, it is usually sufficient and indeed economical to remove sufficient dye from the elastomeric fibre to achieve an acceptable colour fastness in the dyed substrate.

The dyed substrate obtained by the present method preferably is dyed substance as described below.

Another aspect of the present invention relates to a dyed substrate comprising:

(i) elastomeric fibre containing at least 30 wt. % of a first polymer and 0.01 mg/kg to 10 g/kg of a first dye, said first polymer having a glass transition temperature $T_1$ of less than 60° C.; and (ii) non-elastomeric companion fibre containing more than 50 wt. % of a second polymer and at least 1 g/kg of a second dye, said second polymer being polymer having no glass transition temperature or polymer having a glass transition temperature $T_2$ that is at least 20° C. higher than $T_1$;

wherein the first dye and the second dye are composed of the same one or more dyestuffs; and wherein the concentration of the first dye in the elastomeric fibre is at least three times lower than the concentration of the second dye in the companion fibre.

The concentration of the first dye in the elastomeric fibre equals the sum of the concentrations of the one or more dyestuffs that are contained in the elastomeric fibre. Likewise, the concentration of the second dye in the companion fibre equals the sum of the concentrations of the one or more dyestuffs that are contained in the companion fibre.

The same combination of two or more dyestuffs is present in the elastomeric fibre and the companion fibre of the dyed substrate if said substrate was dyed with a dye containing this particular combination of dyestuffs. In case the substrate has been dyed with such a combination, the composition of the first dye in the elastomeric fibre and the composition second dye in the companion fibre will usually be different. For instance, if the substrate has been dyed with a 1:1 mixture of dyestuff A and dyestuff B, dyestuff A may be the main component of the first dye in the elastomeric fibre and dyestuff B may be the main component of the second dye in the companion fibre if dyestuff A has a higher affinity for the elastomeric fibre than dyestuff B and if dyestuff B has a higher affinity for the companion fibre than dyestuff A.

The dyed (and subsequently extracted) substrate of the present invention is unique in that the elastomeric fibre has a very low dye content in comparison with the dyed companion fibre.

Typically, the elastomeric fibre contains less than 8 g/kg, more preferably less than 6 g/kg and most preferably less than 2 g/kg of the first dye.

The companion fibre in the dyed substrate preferably contains at least 3 g/kg, more preferably at least 4 g/kg and most preferably 5-30 g/kg of the second dye.

According to a particularly preferred embodiment of the invention the concentration of the first dye in the elastomeric fibre is at least 3.2 times lower, more preferably at least 3.5 times lower, even more preferably at least 4 times lower and most preferably at least 5 times lower than the concentration of the second dye in the companion fibre.

The dyed substrate preferably is dyed yarn, dyed fabric or dyed garment. More preferably, the dyed substrate is a dyed fabric, even more preferably a dyed knitted fabric, a dyed woven fabric or a dyed non-woven fabric.

The elastomeric fibre typically represents at least 1 wt. %, more preferably 1-35 wt. % and most preferably 3-20 wt. % of the dyed substrate of the present invention. The non-elastomeric companion fibre typically represents at least 50 wt. %, more preferably 65-99 wt. % and most preferably 80-97 wt. % of the dyed substrate. Together, the elastomeric fibre and the companion fibre preferably constitutes at least 30 wt. %, more preferably at least 50 wt. % and most preferably at least 80 wt. % of the dyed substrate.

The elastomeric fibre contained in the dyed substrate preferably is an elastomeric fibre as described herein before. Likewise, the non-elastomeric companion fibre in the dyed substrate preferably is a companion fibre as described herein before.

The first dye in the elastomeric fibre typically contains at least 70 wt. %, more preferably at least 75 wt. % and most preferably at least 80 wt. % of disperse dye.

The second dye in the companion fibre typically contains at least 70 wt. %, more preferably at least 75 wt. % and most preferably at least 80 wt. % of disperse dye.

The dyed substrate of the present invention typically comprises elastomeric fibres that are virtually colourless and non-elastomeric companion fibres that are intensely coloured.

Accordingly, in a preferred embodiment, the colour intensity of the elastomeric fibre is less than K/S=5, more preferably less than K/S=4 and most preferably less than K/S=3, wherein K/S is the Kubelka Munk measure for colour depth, a generally accepted standard in textile industry The colour intensity of the companion fibre in the dyed substrate typically exceeds K/S=6, more preferably it exceed K/S=7 and most preferably it exceed K/S=8.

The colour intensity (K/S) of the elastomeric fibre is preferably at least 2 times, more preferably at least 2.5 times and most preferably at least 3 times lower than the colour intensity of the companion fibre.

Due to the low dye concentration of the elastomeric fibre in the dyed substrate of the present invention, the colour fastness of the dyed substrate is very high.

The dyed substrate of the present invention typically has a wash fastness of at least 3 and more preferably of at least 4 for staining onto diacetate, bleached cotton, polyamide, polyester, acrylic and wool, where fastness is defined and determined by international standard ISO 105.

In accordance with another preferred embodiment, the dyed substrate has both a dry and a wet crocking fastness of at least 3, more preferably of at least 4 where fastness is defined and determined by international standard ISO 105.

In accordance with yet another preferred embodiment, the dyed substrate has a migration fastness of at least 3, more preferably of at least 4, where migration fastness is defined and determined by international standard ISO 105.

According to a particularly preferred embodiment, the dyed substrate is obtainable and even more preferably obtained by the dyeing method described herein.

A further aspect of the invention relates to an article containing a dyed substrate as described herein before, said article being selected from apparel, footwear, upholstery, automotive textiles, industrial textiles, medical textiles and trimmings The invention is further illustrated by means of the following non-limiting examples.

EXAMPLES

Example 1

A knitted and scoured textile that contained a blend of polyester (PES) and elastane (EL) was dyed in supercritical carbon dioxide (scCO2) using the dyeing machine that is schematically depicted in FIG. 1. The textile contained 12% EL and 88% PES.

The dye employed consisted of a mixture of 3 disperse dyestuffs. The types of dyestuffs used and the amount of dye introduced into the dyeing machine (100 L), expressed as % by weight of textile, are shown in Table 1.

TABLE 1

| Dyestuff | % by weight of fibre |
|---|---|
| Disperse yellow 211 | 0.057 |
| Disperse Orange 61 | 0.021 |
| Non-commercial new disperse scarlet dye | 0.449 |

The dyeing machine depicted in FIG. 1 comprises the following elements:

1. dyeing vessel
2. $CO_2$ storage vessel
3. dye holder
4. heater
5. reducing valve
6. separator
7. circulation pump
8. pressurisation pump The textile sample was dyed in the dyeing machine using the following procedure:

dye was introduced into the dye holder;

textile was introduced into the dyeing vessel;

the dyeing vessel was closed $CO_2$ was pumped from the storage vessel via the heater into the dyeing vessel using the pressurization pump to achieve a pressure of 250 bar the circulation pump was switched on to circulate the scCO2 continuously through the dye holder and the textile for 60 minutes. During the first few minutes of circulation, the heater brought the conditions to 120° C. and 250 bar.

In this way, simultaneous dye dissolution into the scCO2 and dye impregnation into the textile was realized.

After the dyeing procedure had been completed, the $CO_2$ was returned to the storage vessel by depressurization through the reducing valve, through the separator vessel to capture the dye that precipitates during depressurization and finally through a condenser (not shown) that renders the $CO_2$ liquid before it is introduced into the storage vessel, ready for re-use in the next batch.

The dyed textile was taken out of the dyeing vessel and analysed regarding fastness properties and colour (see Table 2).

Next, the dyed textile was put back into the dyeing vessel and the vessel was again filled with scCO2 as described above. This time no dye was present in the dye holder and the circulation conditions were set to 40° C. and 250 bar. During circulation, the pressurization pump was kept running together with the circulation pump during an extraction time of 120 minutes. In this way it was ensured that extracted dye was continuously removed from the circulating scCO2 in the separator. Depressurization was done in the same way as described above.

Again, the textile was taken out of the dyeing vessel and analysed regarding fastness properties and colour. The results of these analyses are shown in Table 2. The colour after dyeing was compared to the colour after extraction, using a textile spectrophotometer. No measurable or visible colour differences were detected, indicating that the quality of the dyed product is not affected by the extraction process.

TABLE 2

| | | After scCO2 dyeing | After scCO2 extraction |
|---|---|---|---|
| Wash fastness [1] ISO 105 | on diacetate | 2-3 | 4 |
| | on bleached cotton | 3-4 | 5 |
| | on polyamide | 3 | 4 |
| | on polyester | 3 | 4 |
| | on acrylic | 3-4 | 5 |
| | on wool | 4 | 5 |
| Dry rubbing fastness [1] ISO 105 | on mercerised cotton | 3-4 | 4-5 |

[1] Both wash fastness and dry rubbing fastness are rated on a scale of 1-5 where a rating of 5 signifies negligible staining onto acetate, cotton, polyamide, polyester, acrylic and wool and 1 signifies maximum staining.

The invention claimed is:

1. A method of dyeing a substrate comprising:

(i) elastomeric fibre comprising at least 30 wt. % of a first polymer having a glass transition temperature $T_1$ of less than 60° C., and (ii) non-elastomeric companion fibre containing more than 50 wt. % of a second polymer, the second polymer being polymer having no glass transition temperature or polymer having a glass transition temperature $T_2$ that is at least 20° C. higher than $T_1$, the method comprising:

(a) contacting the substrate with a dyeing medium to produce a pre-dyed substrate comprising dyed elastomeric fibre and dyed companion fibre; and (b) contacting the pre-dyed substrate with an extraction medium at a temperature $T_e$ and a pressure $P_e$, to produce a high fastness dyed substrate, the extraction medium comprising at least 50 wt. % of supercritical or liquefied carbon dioxide;

wherein $T_e$ exceeds $T_{g1,extraction}$ wherein $T_e$ is less than $T_{g2,extraction}$ in case the traction and traction companion fibre contains more than 50 wt. % of polymers having a glass transition temperature $T_2$; $T_{g1,extraction}$ representing the glass transition temperature of the first polymer in carbon dioxide at pressure $P_e$; and $T_{g2,extraction}$ representing the glass transition temperature of the second polymer in carbon dioxide at pressure $P_e$.

2. The method according to claim 1, wherein the dyeing medium comprises at least 50 wt. % of a supercritical fluid and a dye.

3. The method according to claim 2, wherein the dyeing medium contains at least 70 wt. % of carbon dioxide.

4. The method according to claim 2, wherein the dyeing medium has a pressure in excess of 50 bar.

5. The method according to claim 1, wherein the dyeing medium comprises at least 50 wt. % of an aqueous liquid and a dye.

6. The method according to claim 1, wherein the dye comprises a disperse dyestuff.

7. The method according to claim 1, wherein the second polymer has a glass transition temperature $T_2$ that is at least 20° C. higher than $T_1$ and wherein the method comprises the steps of contacting the substrate with the dyeing medium at a pressure $P_d$ and temperature $T_d$ that exceeds $T_{g2,dyeing}$, followed by contacting the pre-dyed substrate with the extraction medium at a temperature that is below $T_{g2,extraction}$; $T_{g2,dyeing}$ representing the glass transition temperature of the second polymer in carbon dioxide at pressure $P_d$.

8. The method according to claim 1, wherein the second polymer is cellulose and wherein the method comprises contacting the substrate with a dyeing medium containing a reactive dyestuff, followed by contacting of the pre-dyed substrate with the extraction medium at a temperature of not more than 120° C.

9. The method according to claim 1, wherein the pre-dyed substrate is contacted with the extraction medium at a pressure in excess of 50 bar.

10. The method according to claim 1, wherein the substrate is yarn, fabric or garment.

11. The method according to claim 1, wherein the elastomeric fibre contains at least 60 wt. % of the first polymer.

12. The method according to claim 1, wherein the companion fibre contains at least 60 wt. % of the second polymer.

13. The method according to claim 1, wherein the first polymer comprises at least 85 wt. % of segmented polyurethane.

14. The method according to claim 1, wherein the second polymer is selected from polyester, nylon, rayon, cellulose, aramids, silk, wool, polyolefins and combinations thereof.

15. The method according to claim 1, wherein the pre-dyed substrate is contacted with the extraction medium at a temperature in the range of 10-60° C.

16. The method according to claim 1, wherein at least 30 wt. % of the dye contained in the elastomeric fibre is removed by the extraction medium.

* * * * *